United States Patent [19]

Cave et al.

[11] Patent Number: 4,603,512

[45] Date of Patent: Aug. 5, 1986

[54] APPARATUS FOR LAPPING A FACET ON A TIP OF A WORKPIECE

[75] Inventors: Eric F. Cave, Indianapolis, Ind.; James J. Cowden, Beverly, Mass.

[73] Assignee: RCA Corporation, Princeton, N.J.

[21] Appl. No.: 685,723

[22] Filed: Dec. 24, 1984

[51] Int. Cl.[4] ..... B24B 9/16

[52] U.S. Cl. ..... 51/229; 51/122; 51/134; 51/237 T; 51/165.75

[58] Field of Search ..... 51/229, 237 T, 122, 51/129, 131.1, 134, 125.5, 283 R, 165.75

[56] References Cited

U.S. PATENT DOCUMENTS 3,624,968 12/1971 Leibowitz ..... 51/229 X 4,167,085 9/1979 Elbe ..... 51/229

OTHER PUBLICATIONS

"Crystal Lapping Apparatus", Mandonas, Western Electric Technical Digest, No. 18, Apr. 1970, pp. 27–28.

*Primary Examiner*—Frederick R. Schmidt

*Assistant Examiner*—Debra S. Meislin

*Attorney, Agent, or Firm*—Birgit E. Morris; Donald S. Cohen

[57] ABSTRACT

An apparatus for lapping a facet at the tip of a stylus by softly setting the tip down adjacent a rotating scaife comprises a moveable carriage supported on a platform. The carriage is moved vertically along a second axis substantially orthogonal to the first axis. A stylus holder operates to pivot the stylus toward the scaife and is biased by a spring or weight to assure a soft set down of the stylus tip on the scaife. A displacement sensor senses the angular displacement of the holder and generates a displacement signal proportional to the angular displacement relative to a predetermined reference position.

8 Claims, 8 Drawing Figures

5
3
106
34
103
116
50
55
55
51
32
12
13
5
3
4
24
20
54
21
81
22
46
82
37
38
48
44
84
39
38
36
4

APPARATUS FOR LAPPING A FACET ON A TIP OF A WORKPIECE

This invention relates to lapping a facet at the tip of a stylus by setting the tip down adjacent a rotating scaife.

BACKGROUND OF THE INVENTION

Information playback systems frequently utilize a stylus for reading signals from the surface of an information record, typically a plastic disc that contains stored video and audio information. In some systems, the information record has a fine spiral groove to guide the tip of a stylus that contains a thin electrode. In these systems, the stylus tip is made of a material having sufficient hardness to withstand the abrasion caused from tracking the groove. Materials which possess such hardness, such as diamond, generally have a crystallographic structure which presents surfaces exhibiting different qualities depending upon which crystallographic plane the surfaces are oriented along. The video disc stylus utilized in the CED (capacitance electronic disc) system is tapered to form the prow of the tip, and is also lapped to form a keel having a V-shaped shoe for its bottom portion. The keel-shaped tip has a shoe length of about 3 to 5 μm and a thickness of about 2 μm. Making a long-shanked stylus entirely from the same material may become expensive, particularly when the tip material, for example, diamond, exceeds the cost of other suitable materials from which the shank can be made.

In order to reduce manufacturing costs, the shank of the stylus may be made from a different material which is less expensive than the crystallographic tip material. For example, a small diamond stone may be mounted at the end of a relatively long metallic shank, such as a cylindrical titanium rod. The diamond stone utilized may be a synthetic diamond stone which is less expensive to obtain than a natural diamond stone. The synthetic diamond stone has a plurality of facets oriented along the {100} family of planes and a plurality of facets oriented along the {111} family of planes. The diamond stone is typically mounted in a concave-shaped cavity at the end of the metallic shank by any means capable of holding the stone therein, such as utilizing a braze, setting the stone in a pocket of adhesive epoxy, a braze, or the like.

In fabricating the keel-shaped tip from the shank-mounted diamond stone, the end at which the stone is mounted is first coned in order to form a conical diamond tip and also to remove a portion of the surrounding shank metal so that it will not interfere with subsequent stylus processing. A novel apparatus for performing this coning is described in U.S. Pat. No. 4,417,423 issued Nov. 29, 1983 to E. F. Cave and J. J. Cowden entitled "Stylus Coning Fixture." The coning operation disclosed in that patent produces a prismatic cone which exhibits four-fold symmetry due to the anisotropic hardness of the diamond crystalline structure. The crystallographic directions are automatically revealed thereby providing an alignment means for orienting the stylus during subsequent processing. See also U.S. Pat. No. 4,403,453 issued Sept. 13, 1983 to E. F. Cave and J. J. Cowden entitled "Stylus Coning Fixture" for a stylus tip positioning apparatus.

Following the coning step on the tip, an electrode facet is lapped along one of the sides of the prismatic cone. After depositing a conductive electrode onto this electrode facet, two intersecting prow facets are lapped adjacent the electrode facet. In the manufacture of a plurality of substantially uniform styli, it is desirable that the lapping of the electrode and prow facets be carefully controlled, especially since the rate of machining a particular facet, and consequently the time required for lapping that facet, may vary from one stylus to the next.

See U.S. Pat. Nos. 3,902,283 issued Sept. 2, 1975 and 4,106,240 issued Aug. 15, 1978 for descriptions of apparatus that facet gems, but not suitable for faceting a plurality of stylus tips rapidly and without damaging the tips during the set down operation.

To control precisely the lapping of the styli and thereby achieve styli of substantially uniform shape, the present invention provides a novel apparatus for softly setting the stylus tip down on a rotating scaife and for uniformly lapping a facet at the tip of a stylus without damaging the stylus tip.

SUMMARY OF THE INVENTION

The present invention comprises an apparatus and method for lapping a facet at the tip of a stylus by setting the tip down adjacent a rotating scaife. The apparatus includes a carriage supported on a platform by means for translating the carriage along a first horizontal axis. A mounting block is attached to the carriage means for moving the block vertically. A stylus holder in the form of a turret is mounted adjacent the mounting block in a manner causing the holder to pivot toward the scaife about an axis substantially orthogonal to the second axis. Affixed to the stylus holder is means for sensing the end position or angular displacement of the holder and generating a signal indicative of the angular position or displacement.

DETAILED DESCRIPTION OF THE PREFERRED EMBODIMENT

Figure 1:
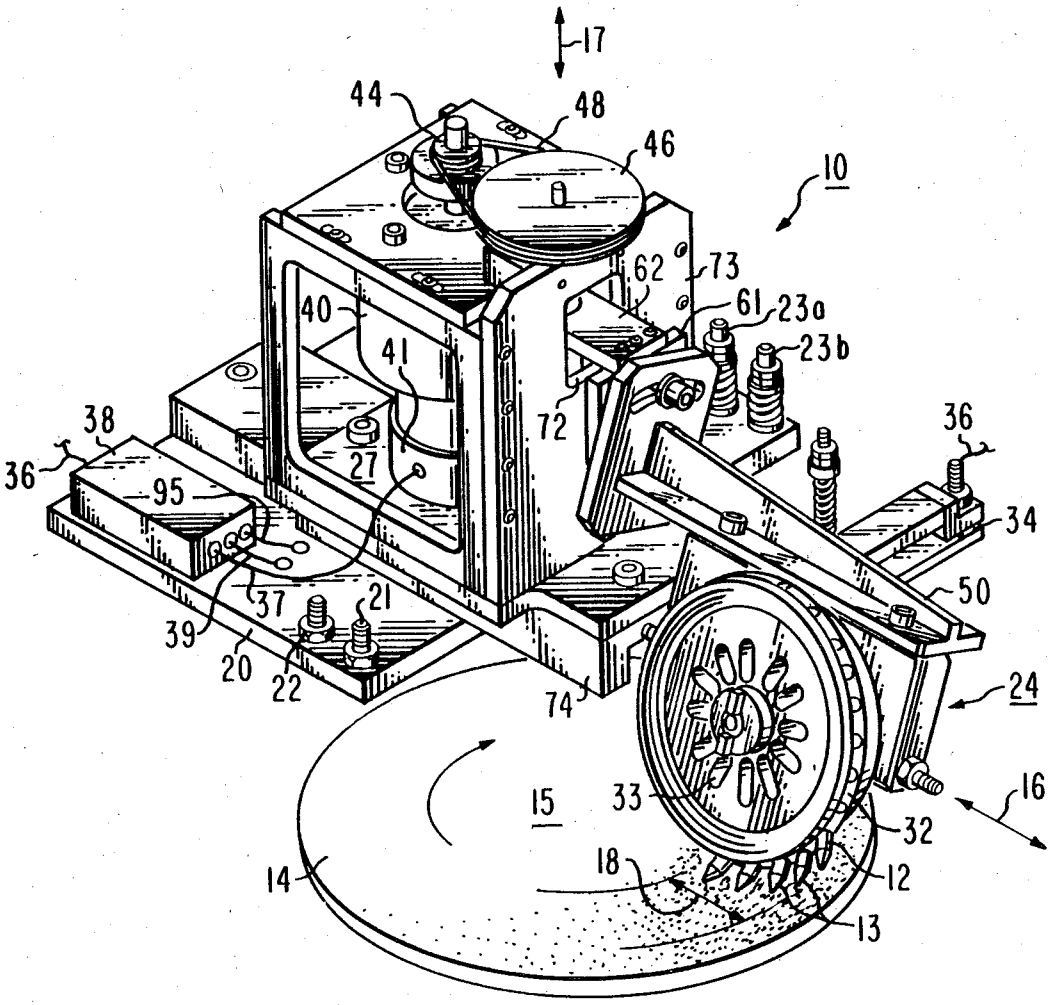
FIG. 1 is a perspective view of the present novel apparatus with stylus positioned adjacent a rotating scaife.

In FIG. 1 of the drawing there is shown one embodiment of an apparatus 10 for lapping a facet at the tip 13 of a stylus 12 by setting the tip 13 down on a major surface 15 of a rotating scaife 14. Scaife 14 is rotated by a motor (not shown) in a given rotation, as indicated by the arrow. It is a feature of this invention to set the tip 13 softly on the surface 15 to reduce, if not obviate, damage to tip 13. A typical force to effect a gentle set down is in the range of 10–50 grams, typically, 25 grams. While the embodiment of the apparatus 10 is described for lapping a diamond tip 13 supported by a stylus 12, such as used in a video disc CED system described above, it should be understood the apparatus 10 can be used for lapping any material requiring accurate dimensions and angle for a facet.

The apparatus 10 of the invention, as shown in perspective view in FIG. 1, comprises a platform 20 attached by a pair of nutted-bolts 21 and 22 to a support structure (not shown). The apparatus 10 is thus positioned adjacent the scaife 14 so as to provide access to the surface 15 as shown. A pair of adjustable springs 23*a* and 23*b* are used to level the platform 20 with respect to the scaife 14. A carriage 24 carrying one or more styli 12 is adapted to be reciprocated, that is, moved back and forth along the axis 16 and to be further moved in a vertical direction along axis 17. The stylus tip 13 is faceted during the reciprocating motion but faceting is ceased upon being lifted from the surface 15.

The carriage 24 is formed generally of a T-shaped bracket 50 and a flat plate 62. The plate 62 is arranged to be moved vertically along the second axis 17 to lift and lower the carriage 24 whereby a stylus holder in the form of a turret 32 carrying one or more the styli 12, is moved in a vertical direction with respect to the surface 15 of the scaife 14.

Figure 5:
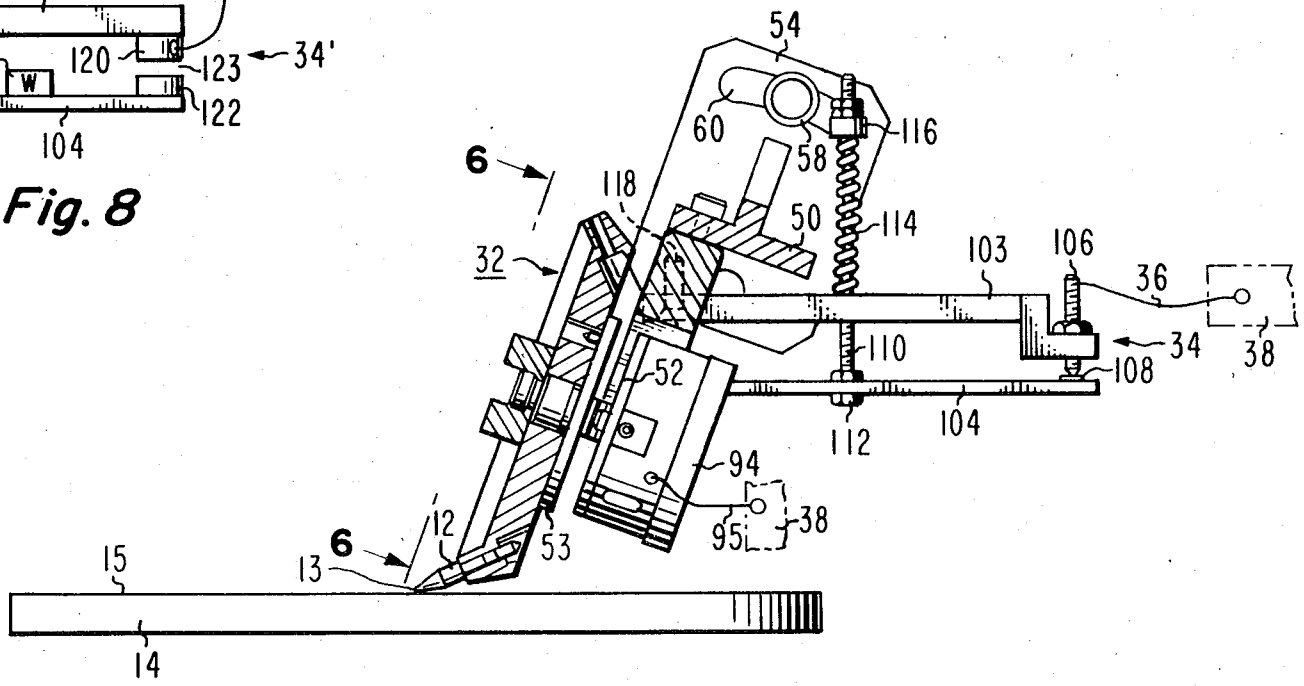
FIG. 5 is a partial cross-sectional view of the stylus holder taken along line 5—5 of FIG. 2.

In practice, a plurality of styli 12 are supported in the turret 32 that is rotatably driven by a stepper motor 94, as shown in FIG. 5, to be described. Slots 33 are provided in the turret 32 to reduce the weight of the turret to reduce thereby its inertia when it is stepped to advance the next stylus 12 to be faceted. Moreover, the turret 32 is arranged to be adjustably tilted about the axis 16 so as to tilt the individual stylus 12 closest to the surface 15 to a desired facet angle. A sensor means 34 positioned adjacent the turret 32 functions to sense the angular displacement of the turret 32 relative to the horizontal plane of the surface 15 of scaife 14. Sensor 34 provides a signal on conductive path 36 to a microprocessor 38 which, via wire 37, energizes a motor control 41 to operate a motor 40. Motor 40, when operated, causes a drive pulley 44 to drive a pulley 46 by means of a belt 48. Pulley 46, upon rotation, actuates mechanisms, to be described, for vertically moving the plate 62 and thus, the carriage 24. Accordingly, the movement and position of the stylus 12, and particularly the tip 13 relative to the surface 15, are controlled by the apparatus 10. The various components and subassemblies of the apparatus 10 to effect the principal movements described in general hereinabove will now be described in detail.

Figure 2:
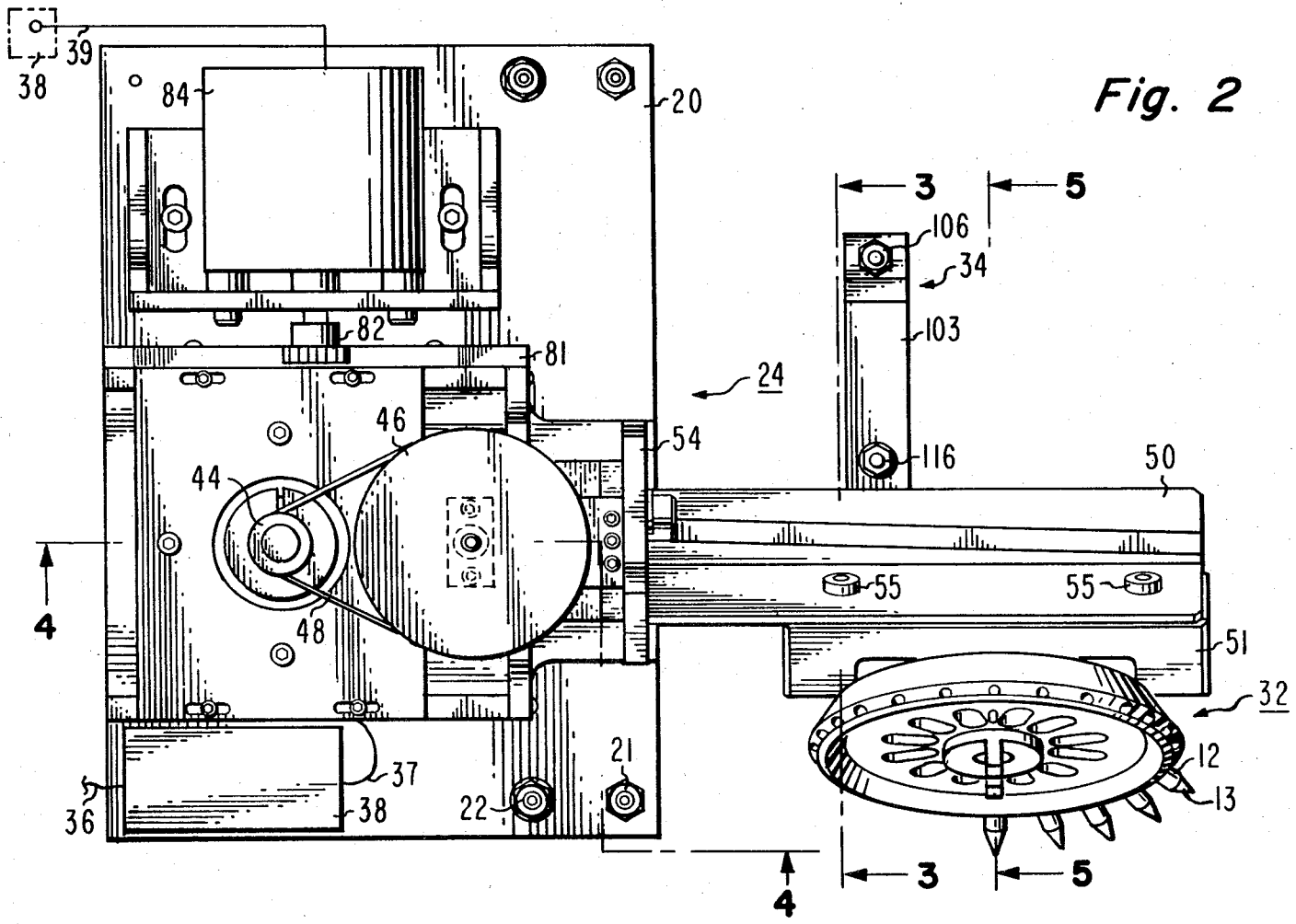
FIG. 2 is a plan view of the apparatus shown in FIG. 1.
Figure 3:
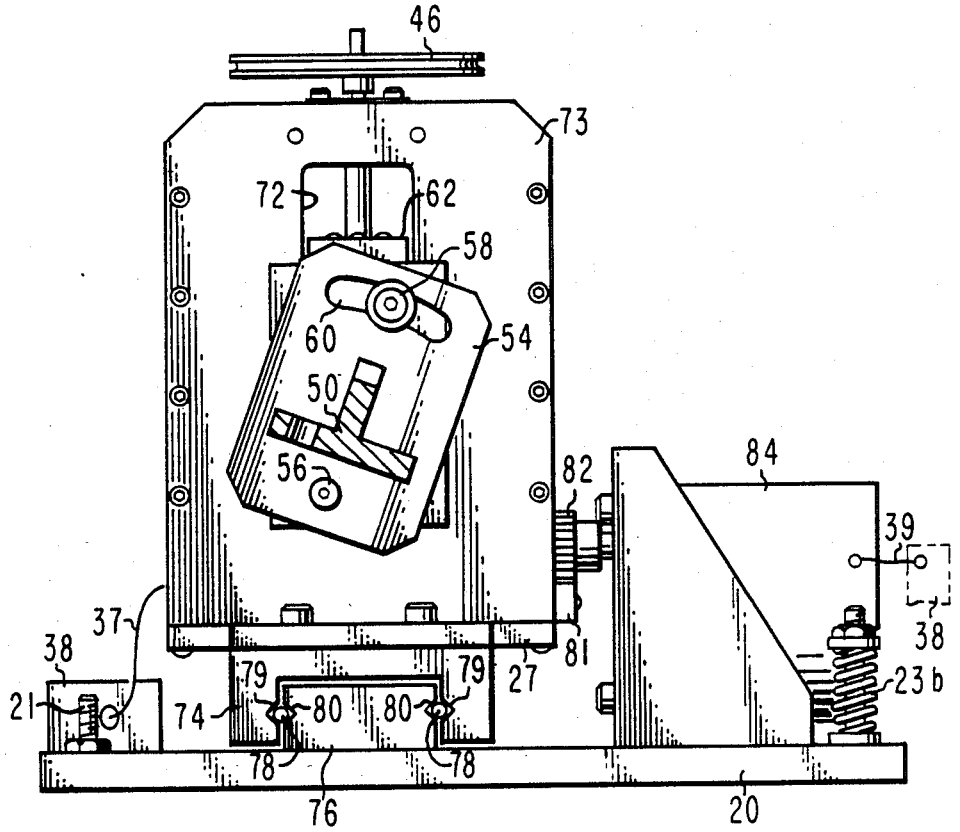
FIG. 3 is an elevation view taken along line 3—3 of FIG. 2.
Figure 4:
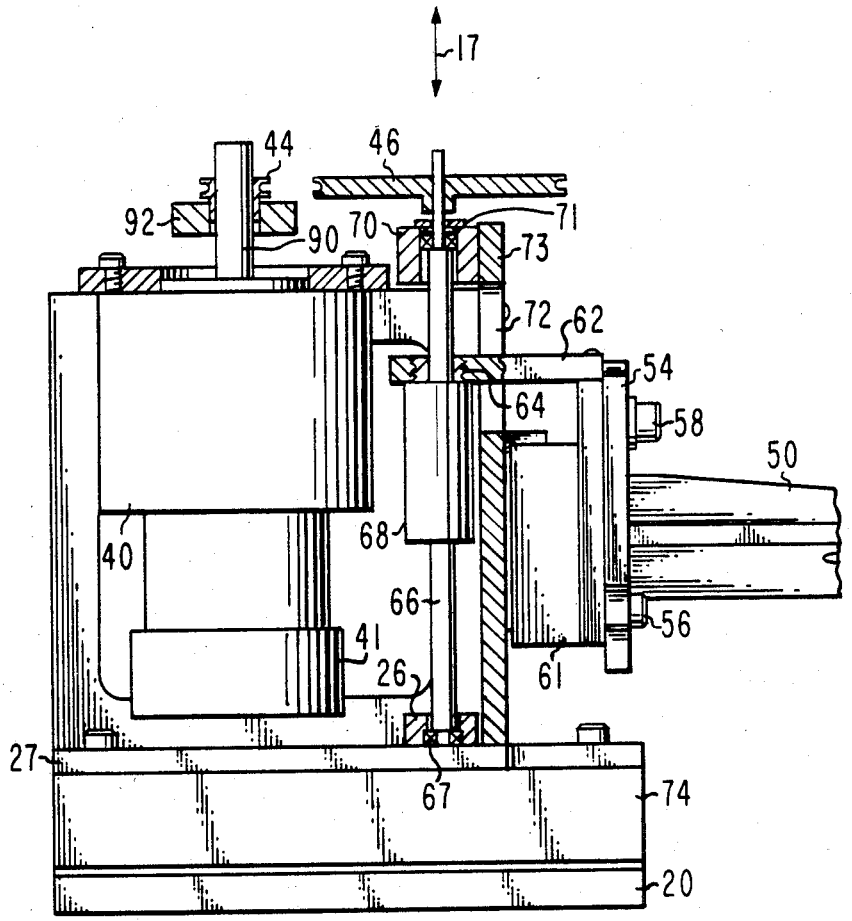
FIG. 4 is a partial cross-sectional view taken along line 4—4 of FIG. 2.

The manner in which the carriage 24 is arranged to be reciprocated back and forth along axis 16 and vertically along axis 17 will now be described with reference particularly to FIGS. 2, 3 and 4. Carriage 24 carries the stylus-holding turret 32 by means of a T-shaped bracket 50 connected to a turret support plate 51 by a pair of fastening bolts 55. T-bracket 50 is attached to face plate 54 by a screw 56 and an adjustment screw 58 which passes through an arcuate aperture 60 in plate 54. The turret support plate 51 is adjusted in angular orientation by being pivoted about the screw 56. The screw 58, when loose, allows for limited movement of the plate 54 within the ends of the arcuate aperture 60. Plate 54 is connected by screws 56 and 58 to a vertical plate 61 which, in turn, is connected, as by a welded connection, to the flat, horizontal plate 62. Plate 62 is provided with a threaded aperture 64 which receives a rod 66 coupled at its upper end to the pulley 46 and supported at its lower end by a bearing 67 supported on a base plate 27. The upper end portion of the rod 66 is supported by a bracing block 70 which is connected to a vertical wall plate 73. A spring washer 71 covers the open end of block 70. Rod 66 further engages by its threads (not shown) a conventional miniature ball screw 68 in the form of a cylinder attached to plate 62 via a threaded neck 64. As the rod 66 is rotated by the motor-driven pulley 46, the plate 62, and thus the carriage 24, are moved vertically in either direction as indicated by double-headed arrow 17 in response to the rotation of pulley 46. Plate 62 is free to move vertically through a window 72 provided in the vertical wall plate 73.

The carriage 24 is reciprocated horizontally as it is carried by the movement of the base plate 27 via the connection to rod 66 and flat plate 62. Plate 27 is connected to and supported by an inverted U-channel 74. A track 76 mounted on the platform 20 is positioned in mating relationship with the channel 74. A ball-slide formed of a plurality of roller-bearing balls 78 is provided in the channel 74 to ride in grooves 80 of the track 76 and grooves 79 in the channel 74 to provide a smooth and friction-reduced movement of the plate 27. Relative movement of the plate 27 carried by channel 74 on the track 76 is effected by a rack 81 mounted on the carriage support plate 27, engaging the teeth of a pinion 82 that is driven by a stepper motor 84.

Thus the carriage 24 is reciprocated along the first axis 16 as driven by the stepper motor 84. The stepper motor 84 is controlled by microprocessor 38 via conductor 39 to reciprocate the carriage 24 along axis 16 and thereby reciprocate a particular stylus tip 13 carried by the stylus 12 on the surface 15 of the scaife 14 generally in a radial direction back and forth over a band 18 of abrasive material on the surface 15.

The tip 13 is lifted from the surface 15 at the end of the faceting period determined by the sensor 34, to be described, by the upward vertical movement of the carriage 24 via motor 40. Motor 40 is operated under control of the microprocessor 38 via a conductor 37.

Figure 6:
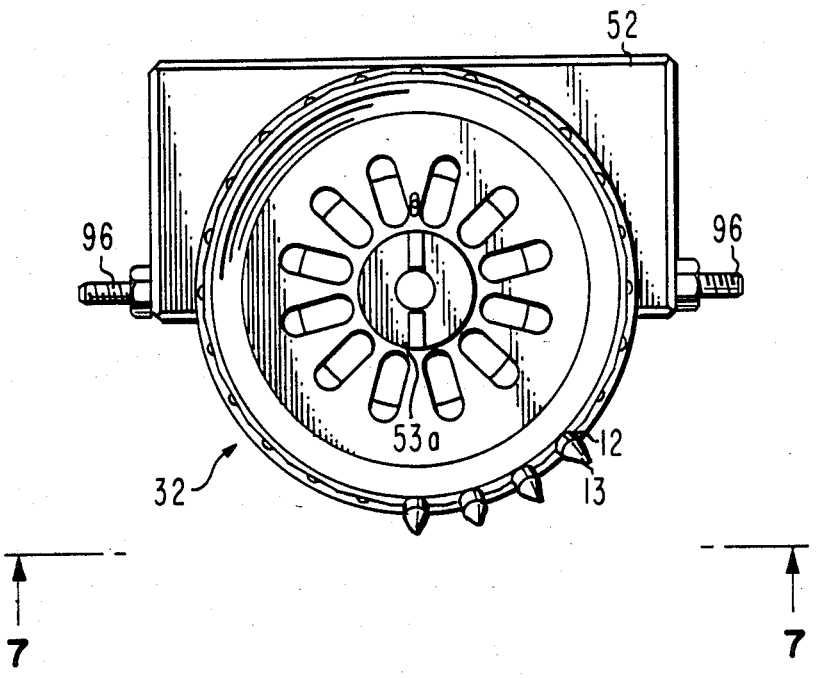
FIG. 6 is an elevation view taken along line 6—6 of FIG. 5.
Figure 7:
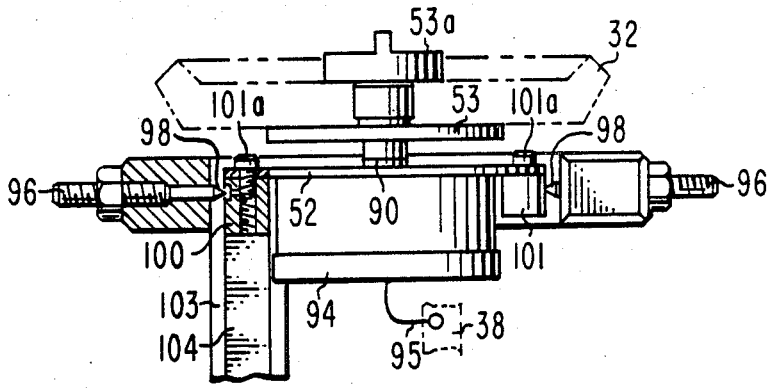
FIG. 7 is an elevation view taken along line 7—7 of FIG. 6, with portions thereof shown in cross-section.

Reference is now made to FIGS. 5, 6 and 7 for a description of the mechanism carrying the stylus holding turret 32. Turret 32 is rotated in stepped-sequence to position each stylus 12, respectively, in faceting position by the stepper motor 94 connected by a shaft 90 through face plate 52. Hub 53 supports the inner surface of turret 32 while retaining nut 53*a* holds the turret 32 in position. The operation of motor 94 is controlled by microprocessor 38 via a conductor 95. The motor 94 is pivotally supported at the pointed ends of a pair of pivot screws 96 seated in respective recessed pivots 98 formed in bearing blocks 100 and 101. The bearing blocks 100 and 101 are connected to face plate 52 by screws 100*a* and 101*a*.

Turret 32 is biased with a counter-balance force to assure, according to the invention, a soft set down of the stylus tip 13 on the rotating surface 15 with a force within the range of 10–50 grams. This feature is provided in one embodiment by a compression spring 114 carried on a screw 110 having one end fixed to a pivotal lever 104 by a nut 112. The screw 110 is free to pass through an enlarged hole in fixed mounting bar 103. The compression force of spring 114 is adjusted by adjusting nut 116. Mountihg bar 103 is suitably attached to the turret support plate 52 by screw 118. Lever 104 is attached to the turret face plate 52. Accordingly, lever 104, as shown in FIG. 7, pivots with pivoting movement of the turret 32 about pivots 98.

The closed or reference position of the bar 103 and lever 104 is defined by an adjustable screw 106 on bar 103 contacting an electrode 108. Electrode 108 is referenced to the electrical ground of the apparatus 10 while screw 106 is connected to the microprocessor 38 via conductor 36. The screw 106 and electrode 108 serve as a means for sensing the angular position of the stylus holding turret 32 relative to the scaife surface 15. The screw 106 is adjusted to contact the electrode 108 at a position corresponding to the desired angle of the facet to be formed on the tip 13. The force of spring 114 is adjusted to provide a torque or counter force preferably of about 10 to 30 grams to offset the weight of the turret assembly. For certain materials, as much as 50 grams of net set down force is satisfactory without damaging the tip. This counter force serves to assure an initial soft set down of the stylus tip 13 on the surface 15 and yet maintain a surface downward force of stylus tip 13 of the scaife 14 to effect an accurately or dimensioned facet.

Figure 8:
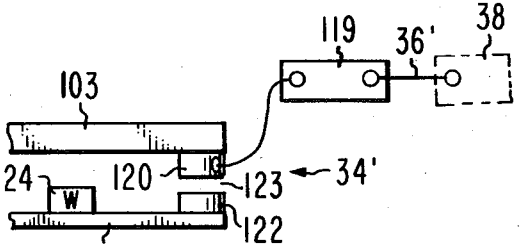
FIG. 8 is a sketch of a modified portion of FIG. 5 illustrating a preferred form of the sensor of the invention.

In another and preferred embodiment of the invention, as shown in FIG. 8, showing a modification of the embodiment illustrated in FIG. 5, the lever 104 is provided with a suitable weight 124 and is positioned on the lever 104 to effect a torque or counter force comparable to that of the spring 114. The weight 124 need not be a discrete body, but may be included in the design to effect by a net distributed counter force equivalent to the discrete body weight 124.

As an alternative to the sensor means 34, a proximity sensor means 34′ may be used to provide a signal that is proportional to the angular displacement of the bar 103 and lever 104 whereby a more sensitive control of the faceting operation may be achieved with a displacement signal that indicates the desired facet is achieved or nearly achieved. The apparatus 10 is programmed via microprocessor 38 to anticipate the end of the faceting cycle and lift the carriage 24 more rapidly and precisely at the desired facet angle by energizing the motor 40.

The sensor means 34′ comprises a conventional proximity sensor 119 utilizing high frequency energy wherein a probe 120 is positioned on lever 103 and a metallic member 122 is positioned on bar 103. The sensor 119 provides a signal over path 36′ to microprocessor 38 proportional to the displacement between the probe 120 and the member 122 by sensing eddy currents generated in the member 122. An adjustable threshold gap 123 defines the position of the desired facet on the tip 13 corresponding to the closed contacts of the sensor 34 of FIG. 5. As the probe 120 is moved toward and away from member 122, the signal on conductor 36′ varies as a function of the spacing therebetween and, accordingly, as a function of the displacement of the turret 32. A suitable proximity sensor 119 is available from the Kaman Company, Colorado Springs, Colo. by its Model KD-2602-2S.

The angle of the facet, while it is being faceted, is continuously monitored. The microprocessor 38 is programmed to respond to the displacement signal and provide a control signal to motor 40 to lift the tip 13 from the surface 15 at the precise angle desired. According to one adjustment of the sensor 34′, the magnitude of the distance in the gap 123 is equal to the amount of lapping required on the tip 12 plus an amount equal to about one-half the amplitude of the displacement signal generated during the lapping period.

The operation of the apparatus 10 will now be described. A plurality, for example, twenty-four styli 12, are positioned by an operator in the turret 32. The tilt of the turret 32 is adjusted by the position of screw 58 within the slot of aperture 60. In the initial position, the turret 32 and styli 12 are lifted above the surface 15 of the scaife 14.

The operation of the apparatus 10 is started for subsequent automatic operation by a switch (not shown) by which the programmed microprocessor 38 starts the rotation of the scaife 14 and reciprocal movement of the carriage 24 over the scaife 14. Motor 94 has been operated to index the first stylus 12 to be faceted in faceting position. Motor 84 is programmed via microprocessor 38 to be energized to reciprocate the carriage 24 via rack 80 and pinion 82. The motor 40 is then energized to lower the carriage 24, and thus the stylus 12, towards the surface 15 by the rotation of ball screw 68 effecting a levering of the plate 62. The stylus tip 13 will be softly set down on the surface as the turret 32 tilts about pivots 98 under control of the counter force effected either by spring 114 or weight 124. With the initial set down of the tip 13, the gap or spacing provided for either of the sensors 34 or 34′ will represent the start of the facet operation. As the faceting progresses by the combined rotation of scaife 14 and the reciprocating action of the carriage 24, the spacing in the sensor 34 will reduce as the facet is enlarged. When the desired facet size is reached, after about 15–20 seconds, the sensor 34 will provide a signal to the microprocessor 38 to cease faceting. Responding to such a signal, the microprocessor 38 causes the carriage 24 to be lifted and thereby removes the tip 13 from the surface 15. The next stylus tip 13 is then rotated into position by the programmed control of stepper motor 94 to rotate the turret 32 by one step position corresponding to the next stylus tip 13 to be faceted. The program then proceeds to repeat the cycle by lowering the carriage 24 and then the next stylus tip 13 onto the surface 15. After all the stylus tips 13 have been faceted, the program stops the operation of the apparatus 10 to await a restart after the replacement by new styli 12.

What is claimed is:

1. An apparatus for lapping a facet on a tip of a workpiece by setting said tip down on a surface of a rotating scaife comprising:

(a) a platform positioned in fixed relation adjacent said scaife;

(b) means connected to said platform for movable supporting a carriage for reciprocal movement in a horizontal direction parallel to a first generally horizontal axis and in a vertical direction that is parallel to a second axis substantially orthogonal to said first axis;

(c) turret means for carrying one or more of said workpieces rotatable about another axis to sequentially position a workpiece over said surface, pivotal means connecting said turret means to said carriage to pivot said turret means about said first generally horizontal axis;

(d) said pivotal means including adjustable torque means for setting the tip of a selected workpiece on said scaife surface at an angle as said carriage is moved in a downward vertical direction, and for controlling the pressure applied to said tip as it is passed against said scaife surface;

(e) sensing means connected to said carriage for sensing an angular displacement of said workpiece holder about said first axis relative to a predetermined reference position and for generating a displacement signal indicative for said angular displacement; and (f) means responsive to said displacement signal for lifting said carriage thereby to lift said workpiece tip from the surface of said scaife when said tip has been provided with a facet having a predetermined angle corresponding to said angular displacement.

2. An apparatus according to claim 1 wherein said carriage support means includes a ball slide oriented along the direction of said first axis and said means for moving said carriage support means in the horizontal direction comprises a stepper motor mounted on said platform and having a drive shaft thereof connected to a pinion gear, said pinion gear being meshed with a rack gear aligned along the direction of said first axis and affixed to said carriage.

3. An apparatus according to claim 1 wherein said vertical moving means comprises a ball screw having a rotatable screw shaft oriented parallel to the direction of said second axis and supported at the ends thereof, respectively, by a pair of angular contact bearings affixed to said carriage, one end of said shaft being coupled to the driveshaft of a motor, said screw shaft being meshed with a movable nut plate having a face plate attached thereto and connected to said carriage by a head-mounting bracket extending from said face plate.

4. An apparatus according to claim 1 wherein said turret carriage means includes a pair of bearing blocks supported, respectively, by a pair of pivot screws extending from said carriage and oriented along the direction of said first axis, the ends of said pivot scres mating, respectively, with pivot bearings disposed in said bearing blocks.

5. An apparatus according to claim 1 wherein said sensing means comprises a proximity sensor having a portion disposed away from said first axis at one end of a fixed mounting bar having the other end thereof affixed to said carriage, another portion of said proximity sensor being positioned at one end of a pivotal lever having the other end thereof affixed to said turret means, the sensor adapted to sense the displacement of said lever from said mounting bar whereby the position of said tip relative to said scaife surface is sensed.

6. An apparatus according to claim 5 wherein said proximity sensor comprises an eddy current proximity measuring device.

7. An apparatus according to claim 5 wherein said torque means comprises a screw having one end thereof connected to said lever and the other end thereof connected to a compression spring supported by said mounting bar in a manner forcing the one end of said screw toward said mounting bar, and means for adjusting the compression of said spring.

8. An apparatus according to claim 1 wherein said displacement signal responsive means includes a programmed microprocessor adapted to control the vertical movement of said carriage in response to said displacement signal by energizing a motor for moving said carriage vertically lifting said workpiece off said surface.

* * * * *

UNITED STATES PATENT AND TRADEMARK OFFICE
CERTIFICATE OF CORRECTION

PATENT NO. : 4,603,512

DATED : August 5, 1986

INVENTOR(S) : Eric Frederick Cave et al.

It is certified that error appears in the above-identified patent and that said Letters Patent is hereby corrected as shown below:

Column 6, line 19, "levering" should be --lowering--.

Column 6, line 49, "movable" should be --movably--.

Column 7, line 30, "carriage" should not be there.

Column 8, line 1, "scres" should be --screws--.

Signed and Sealed this

Eleventh Day of November, 1986

*Attest:*

DONALD J. QUIGG

*Attesting Officer* *Commissioner of Patents and Trademarks*